US008469228B2

(12) United States Patent
Adams

(10) Patent No.: US 8,469,228 B2
(45) Date of Patent: Jun. 25, 2013

(54) SELF-SERVE KIOSK WITH ROTATABLE CONTAINER CAROUSEL

(75) Inventor: Joseph L. Adams, Thorndale (CA)

(73) Assignee: SLEEGERS Engineered Products, Inc., London, Ontario (CA)

( * ) Notice: Subject to any disclaimer, the term of this patent is extended or adjusted under 35 U.S.C. 154(b) by 64 days.

(21) Appl. No.: 13/070,966

(22) Filed: Mar. 24, 2011

(65) Prior Publication Data

US 2012/0241464 A1 Sep. 27, 2012

(51) Int. Cl.
*G07F 11/00* (2006.01)
*B65H 1/00* (2006.01)

(52) U.S. Cl.
USPC ..... 221/120; 221/122; 221/265; 221/277; 221/76; 221/287; 221/197; 221/113; 221/285; 221/286; 221/10; 221/12; 221/2; 221/121; 221/242; 312/97.1; 312/125; 312/116; 312/135; 312/305; 211/131; 211/129; 211/163; 211/58; 47/41.01; 47/83; 222/325

(58) Field of Classification Search
USPC ..... 221/122, 265, 120, 277, 76, 287, 221/197, 113, 285, 286, 10, 12, 2, 121, 242; 312/97.1, 125, 116, 135, 305; 222/325; 211/131, 129, 163, 58; 47/41.01, 83
See application file for complete search history.

(56) References Cited

U.S. PATENT DOCUMENTS

| | | | | |
|---|---|---|---|---|
| 1,494,180 | A | 5/1924 | Mayes et al. | |
| 3,096,907 | A * | 7/1963 | Bouracier | 221/113 |
| 4,188,058 | A * | 2/1980 | Resa et al. | 296/208 |
| 4,278,035 | A * | 7/1981 | Pickett et al. | 111/104 |
| 4,391,388 | A * | 7/1983 | Krakauer | 221/76 |
| 4,498,603 | A * | 2/1985 | Wittenborg | 221/76 |
| 4,778,042 | A | 10/1988 | Warren et al. | |
| 4,839,505 | A * | 6/1989 | Bradt et al. | 235/381 |
| 4,942,954 | A * | 7/1990 | Nesser et al. | 194/351 |
| 5,036,828 | A * | 8/1991 | Heffer | 124/47 |
| 5,067,630 | A * | 11/1991 | Nesser et al. | 221/76 |
| 5,244,266 | A * | 9/1993 | Maldanis | 312/116 |
| 5,313,393 | A * | 5/1994 | Varley et al. | 705/28 |
| 5,360,134 | A * | 11/1994 | Falk et al. | 221/2 |
| 5,545,286 | A * | 8/1996 | Schaupp | 156/570 |
| 5,730,316 | A * | 3/1998 | Falk | 221/122 |
| 5,829,630 | A * | 11/1998 | Fernald | 221/66 |
| 6,085,937 | A * | 7/2000 | Hutchinson et al. | 221/122 |
| 6,192,296 | B1 | 2/2001 | Colmant et al. | |
| 6,695,019 | B2 | 2/2004 | Hasenkopf | |
| 6,742,674 | B2 * | 6/2004 | Castleberry | 221/132 |

(Continued)

FOREIGN PATENT DOCUMENTS

| | | | |
|---|---|---|---|
| DE | 19652147 | A1 * | 5/1998 |
| EP | 1054363 | | 11/2000 |

(Continued)

*Primary Examiner* — Gene O. Crawford
*Assistant Examiner* — Rakesh Kumar
(74) *Attorney, Agent, or Firm* — Woodard, Emhardt, Moriarty, McNett & Henry LLP

(57) ABSTRACT

A dispenser of containers. A carousel is rotatably mounted to a main frame about a vertical axis of rotation and has a plurality of container compartments arranged around the axis and along the length of the axis. A driver mounted to the main frame rotates the carousel around the axis in a single direction and a lock limits rotation of the carousel in any direction when engaged.

12 Claims, 12 Drawing Sheets

U.S. PATENT DOCUMENTS

| | | | | |
|---|---|---|---|---|
| 6,761,194 | B1 | 7/2004 | Blong | |
| 6,874,684 | B1 * | 4/2005 | Denenberg et al. | 235/381 |
| 7,086,198 | B2 * | 8/2006 | Hayden | 47/41.01 |
| 7,537,155 | B2 * | 5/2009 | Denenberg et al. | 235/382 |
| 7,588,165 | B2 * | 9/2009 | Prichard et al. | 221/2 |
| 7,735,680 | B2 * | 6/2010 | Godlewski | 221/122 |
| 7,748,545 | B2 * | 7/2010 | Johnson | 211/78 |
| 2004/0245278 | A1 * | 12/2004 | Steffens et al. | 221/265 |
| 2007/0170201 | A1 * | 7/2007 | Steffens | 221/265 |
| 2010/0152892 | A1 * | 6/2010 | Gavra et al. | 700/232 |

FOREIGN PATENT DOCUMENTS

| | | |
|---|---|---|
| EP | 1494180 | 1/2005 |
| FR | 2506479 | 5/1981 |
| FR | 2 641 887 | 7/1990 |
| WO | WO2010/130913 | 11/2010 |

* cited by examiner

SELF-SERVE KIOSK WITH ROTATABLE CONTAINER CAROUSEL

BACKGROUND OF THE INVENTION

1. Field of the Invention

The present invention relates generally to the field of dispensing means dispensing machines for propane tanks.

2. Description of the Prior Art

Various types of kiosks have been designed to hold tanks of LP gas. As each tank is withdrawn from the kiosk, the space typically is filled by an empty tank. Due to safety concerns, the kiosks are located external to a building thereby requiring a person to leave the building, open the cabinet and remove the full tank while storing the empty tank. The cost and manpower associated with servicing such kiosks has resulted in self-serve cabinets or kiosks located external to the building. The customer accesses the full tank from the kiosk by insertion of a credit instrument and stores the return empty tank in the place occupied by the withdrawn full tank. In general, the cabinets are quite long since it is desirable to store a great number of full tanks without continual restocking of a new set of tanks.

The U.S. Pat. No. 6,761,194 discloses an inert gas dispenser for propane tanks wherein the stored tanks are arranged in rows extending both horizontally and vertically. A plurality of doors are arranged horizontally and vertically with a separate door assigned for each tank compartment for insertion of an empty tank or removal of a full tank. The doors are releasably opened by fluid operated locks connected to a pressurized line. Door sensors and floor sensors indicate whether a tank is absent from the particular compartment or whether a filled or unfilled tank is present.

In the European Patent 1,494,180 of Bernard Barneaud et al., there is shown a cabinet for the management of gas cylinders which are arranged in horizontal and vertical rows where access is granted to a particular container by utilizing keys.

In the PCT WO2010/130913 Application published 18 Nov. 2010 naming Bernhard Barneaud et al., there is shown horizontal and vertical rows of gas cylinders that are sequentially aligned with a door for the removal or insertion of a cylinder. A conveyer moves the two horizontal rows past the door in sequential fashion.

Additional references disclosing cylinder vending machines wherein the cylinders are arranged in horizontal rows are shown in U.S. Pat. No. 5,829,630 of Donald C. Fernald, U.S. Pat. No. 4,778,042 of Peter A. Warren et al., U.S. Pat. No. 6,695,019 of Karl-Peter Hasenkopf, and U.S. Pat. No. 6,192,296 of Gilles Colman et al.

It can be appreciated that arranging LP gas cylinders in horizontal rows requires considerable space for the cabinet or vending machine. There is therefore a need for a more compact tank dispenser. Compactness is achieved by utilizing a rotatable carousel. Such an approach is disclosed in the U.S. published Patent Application 2007/0170201 of Lowell G. Steffens being published on Jul. 26, 2007 and eventually abandoned. Another rotatable carousel for vending propane tanks is disclosed in the U.S. published Patent Application 2004/0245278 of Lowell G. Steffens et al. being published on Dec. 9, 2004 and eventually abandoned. A further carousel for dispensing liquefied gas bottles is disclosed in the French Patent 2641887 wherein the carousel is rotated about a horizontal axis. Despite the prior tank dispensers, there is still a need for a more compact tank dispenser designed to hold a sufficient number of tanks without requiring frequent maintenance.

Safety is of primary concern in tank dispensers since the cabinets store a number of LP gas tanks. Thus, there is a need to provide means, such as, fusible links within the cabinet and also evacuation fans that are triggered under certain conditions. In those dispensers having conveyors or rotatable carousels, there is also concern that the consumer may be injured by the movable conveyor and/or carousel. My dispenser disclosed herein is provided with a catch or lock preventing rotation of the carousel whenever the compartment door is open allowing for the insertion or removal of a tank. Further, the lock is located in such a position to minimize interaction with the external environment such as dirt or ice. The lock prevents rotation of the inside carousel anytime a door is open using a locking mechanism consisting of an arm and a spring extended gas cylinder mounted at the top of the dispenser.

SUMMARY OF THE INVENTION

One embodiment of the present invention is a self-serve kiosk for storing and dispensing tanks. A main frame has a bottom wall, top wall, side walls, front wall and back wall defining an enclosure for storage and dispensing of tanks. A carousel is rotatably mounted atop the bottom wall about a vertical axis of rotation. The carousel has a plurality of separate shelves located around the axis with the levels located along the axis. A plurality of doors are hingedly mounted to the main frame and movable to and from the open position allowing access to the shelves and the closed position limiting access to the shelves. One door is provided for each level leading to the shelf located behind the door. A driver is mounted on the main frame and engaged with the carousel for drivingly rotating the carousel about the axis in a single direction and position a shelf behind each door. A lock is mounted on the main frame and releasably engageable with the carousel limiting movement of the carousel.

It is an object of the present invention to provide a new and improved dispenser of containers.

A further object of the present invention is to provide a rotatable carousel for dispensing containers having a lock to prevent rotation whenever a compartment door is open.

A further object of the present invention is to provide an LP gas tank dispenser that is compact while maximizing the number of tanks stored therein.

Related objects and advantages of the present invention will be apparent from the following description.

DESCRIPTION OF THE PREFERRED EMBODIMENT

Figure 1:
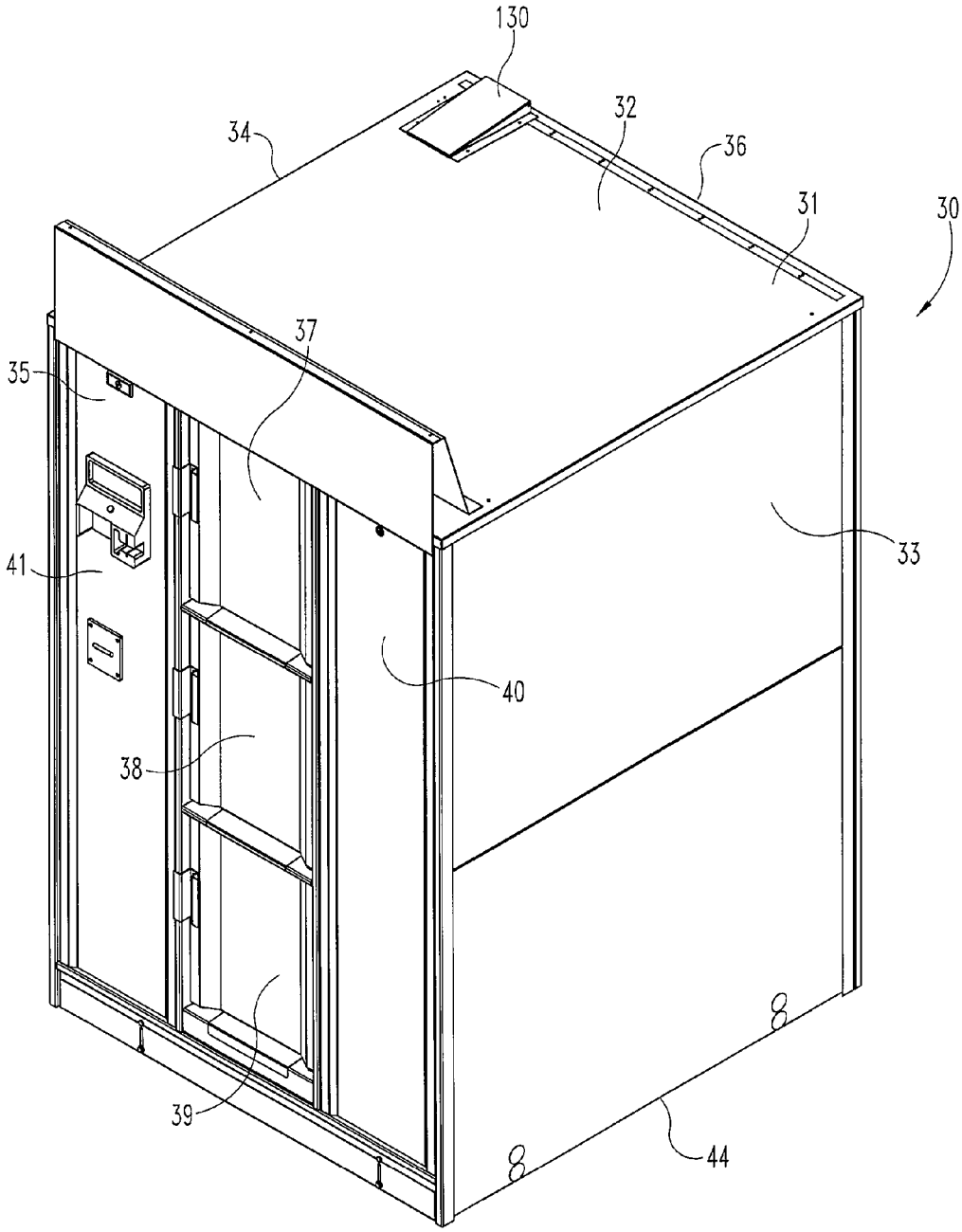
FIG. 1 is a front perspective view of the tank dispenser incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown the dispenser 30 for storing and dispensing containers including LP gas tanks. Dispenser 30 is configured as six sided cabinet 31 enclosing the containers to be stored and dispensed. The cabinet includes a top wall 32 mounted to a pair of side walls 33 and 34 along with a front wall 35 and rear wall 36. These walls, in turn, are mounted atop a bottom wall 44.

Front wall 35 has a number of doors pivotally and hingedly mounted to allow access to compartments within the cabinet. In the embodiment shown in FIG. 1, the doors consist of a top door 37, middle door 38 and bottom door 39 arranged in a vertical row. These doors may be opened and closed to store the empty container provided by the consumer and a full container withdrawn from the cabinet.

Door 40 is movably mounted to the cabinet and may be opened by service personnel to service and refresh the source of nitrogen within the dispenser for powering various locks and actuators. A control door 41 is also movably mounted to the dispenser and may be opened by service personnel for servicing the electronics.

The main frame 42 (FIG. 2) includes a plurality of vertical members 43 mounted to and extending upwardly from the bottom wall 44. A plurality of horizontal cross members 45 have opposite ends secured to vertical members 43 on the two sides and rear of the back of the main frame. In addition, a plurality of diagonal braces 46 have opposite ends secured to members 45 increasing the rigidity of the frame. The front of the frame includes a pair of vertically extending openings 48 and 47 that are closed by doors 40 and 41. Further, three openings 49, 50 and 51 are located between openings 47 and 48 with openings 49-51 being aligned with doors 37-39 to allow access to the carousel compartments located behind the openings. A pair of vertical members 52 and 53 located on the opposite sides of openings 49-51 to separate openings 49-51 from the side openings 47 and 48. Members 52 and 53 are connected to the top and bottom of the frame 42.

A carousel 53 (FIG. 3) is rotatably mounted atop bottom wall 44 and has three shelf levels 54, 55 and 56 that are aligned respectively with openings 49, 50 and 51 as the carousel is rotated. Each shelf level 54-56 is divided into eight separate compartments although a greater number or lesser number of compartments may be provided. The compartments are formed by vertically extending members. For example, shelf level 54 has eight compartments 57-64. Each compartment has an identical design.

Compartment 62 will now be described it being understood that an identical description applies to compartments 57-61, 63 and 64. Compartment 62 is formed on its right side by vertical members 66 and 67 horizontally spaced apart and joined together by a plurality of walls 68. Likewise, a second pair of vertical members 69 and 70 are spaced apart and joined together by walls 71. The bottom wall 72 of compartment 62 has its sides connected to vertical members 66, 67, 69 and 70 and provides the shelf upon which the LP tank or container rests. Each compartment is wedge shaped with the outer members 67 and 70 being spaced apart a distance greater than the horizontal spacing between inner vertical member 66 and 69.

A plurality of ring shaped walls are provided inwardly of each compartment and are attached to the inner vertical members to provide rigidity of the carousel. For example, ring shaped wall 73 is located at the top of the carousel and is positioned immediately inward of and attached to the inwardly located vertically extending members forming each compartment. For example, vertical members 66 and 69 are located outwardly of and attached to ring shaped wall 73. Likewise, a middle ring shaped wall 74 and bottom ring shaped wall 75 are at the top portion of shelf levels 55 and 56 and are located inwardly of and attached to the inwardly located and vertically extending members forming each compartment.

The entire carousel rides on a plurality of wheels located beneath and mounted to the carousel. For example, roller 76 is rotatably mounted to an L-shaped bracket 77 fixed to vertical member 70 and member 109 beneath bottom wall 78. Likewise, roller 79 is rotatably mounted to an L-shaped bracket fixedly mounted to vertical member 67 immediately beneath bottom shelf wall 80 of level 56. An additional pair of wheels may be rotatably mounted to L-shaped brackets fixedly secured to inwardly located vertical members 69, 109 and 66 located respectively beneath bottom shelf walls 78 and 80. In a similar fashion, wheels are rotatably mounted by L-shaped brackets to each vertical member forming the eight compartments for each level and are located on the outward side of each compartment and may be located on the inward side of each compartment allowing the carousel to rotate about a vertical axis atop wall 44.

The carousel is rotatably mounted to a spindle 80 (FIG. 4) mounted to bottom wall 44 and extending there above. Spindle 80 extends through bearing 82 (FIG. 3) fixed to center bottom wall 81 of the carousel, in turn, having an outwardly extending edge portion affixed to the inwardly located vertical members including members 66 and 69. The spindle and bearing allow the carousel to rotate about a vertical axis extending centrally through bearing 82 and spindle 80.

Figure 3:
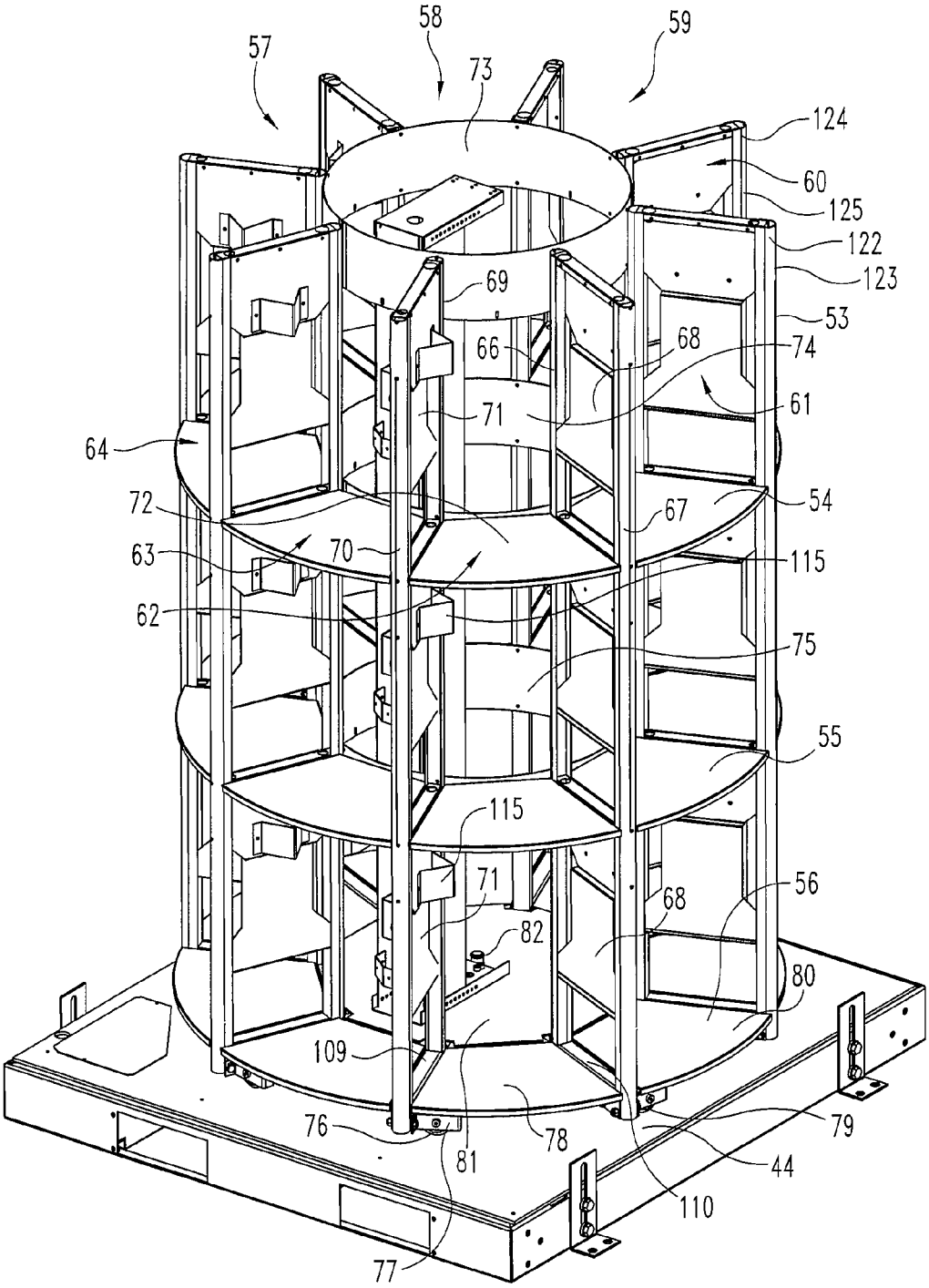
FIG. 3 is a front perspective view of the rotatable carousel mounted atop the bottom floor of the dispenser.
Figure 4:
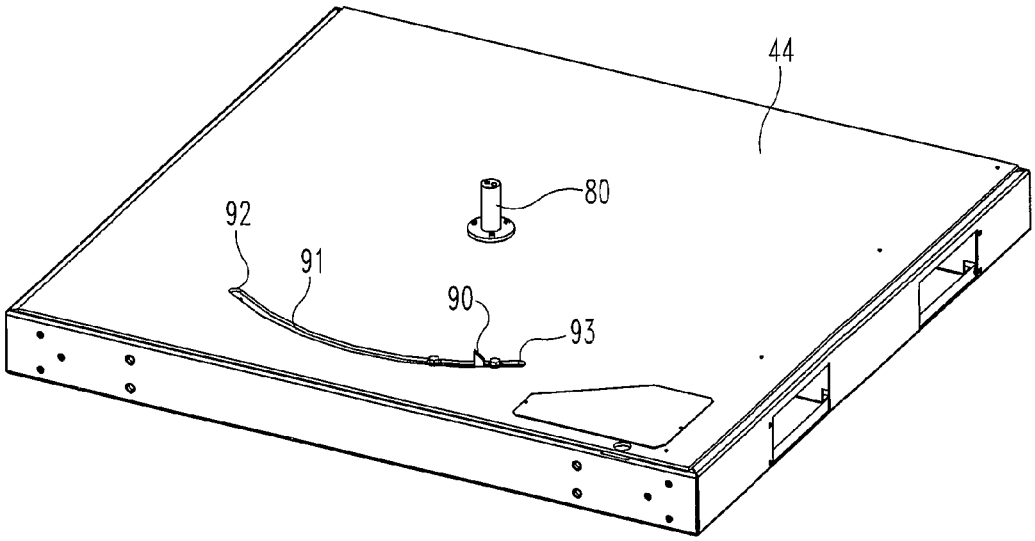
FIG. 4 is an enlarged perspective view of the bottom floor of the dispenser.
Figure 7:
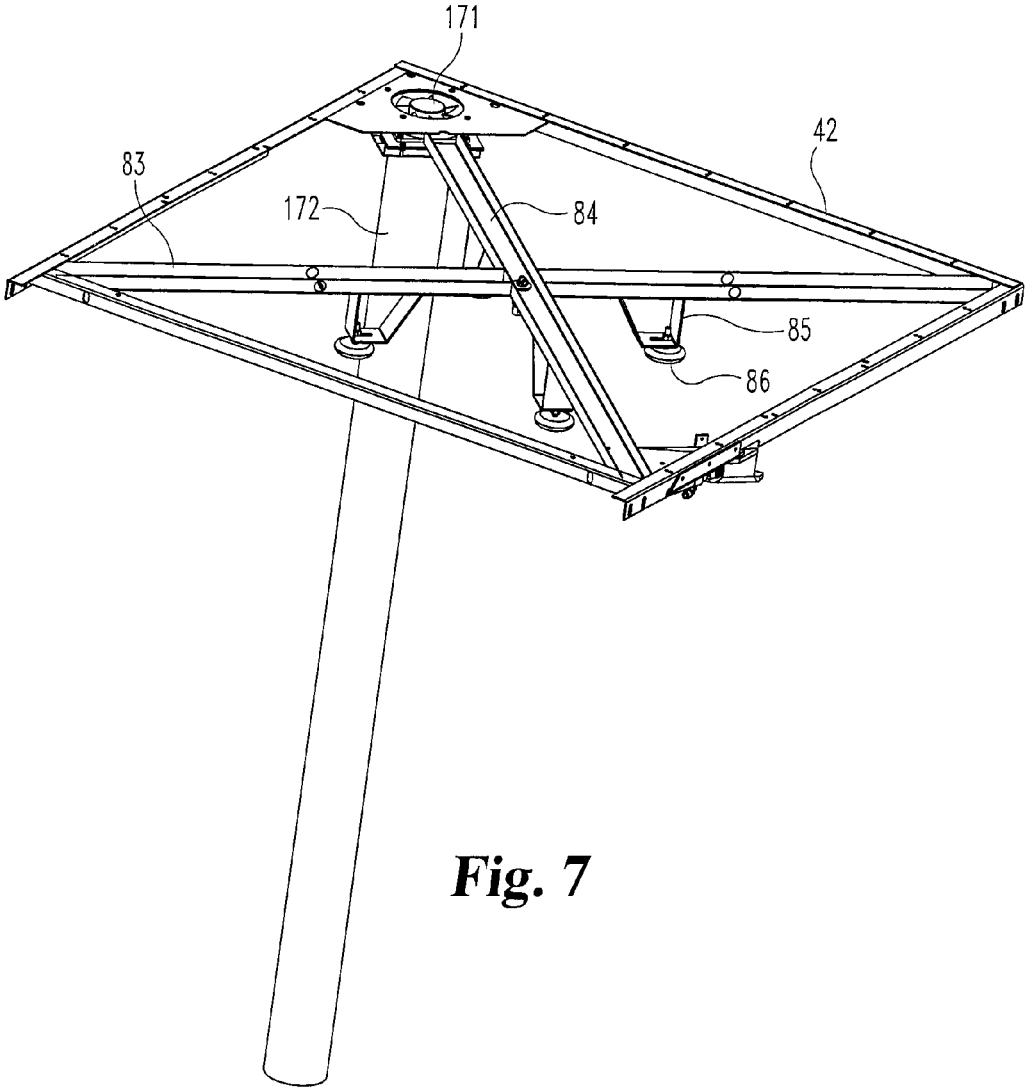
FIG. 7 is a front perspective view of the air vent and vent tube mounted to the top portion of the main frame also illustrating the center ring wheels.

The top of the carousel is guided by a plurality of center ring wheels extending down from atop the main frame into and contacting the inner surface of the top ring shaped wall 73 (FIG. 3). The top of the main frame has a pair of diagonal braces 83 and 84 (FIG. 7) connected together at their central portion with the opposite ends of the diagonal braces attached to the main frame. Upwardly formed U-shaped brackets 85 have their opposite ends attached to members 83 and 84 with center ring wheels 86 rotatably mounted to the bottom end portion of brackets 85. Wheels 86 keep the carousel centered about its vertical axis of rotation. A pair of brackets 85 are mounted to diagonal cross member 83 and a second pair of brackets 85 are mounted to diagonal cross member 84. Roller wheels 86 are spaced apart radially outward from the inner portion of braces 83 and 84 to continuously contact the inwardly facing surface of top ring shaped member 73 thereby guiding the top end of the carousel as it is rotated about the vertical axis extending through spindle 80.

The mechanism for rotating the carousel is a pneumatic or gas cylinder having a piston rod attached to a spring loaded finger 90 (FIG. 4) projecting through a curved slot 91 formed in the bottom wall 44 of the main frame. The length of slot 91 between its opposite ends 92 and 93 corresponds to rotating the carousel ⅛ of a turn or 45 degrees about the vertical axis of rotation for the carousel. Thus, the eight compartments for each level of the carousel are sequentially aligned with the compartments behind doors 37-39.

Figure 5:
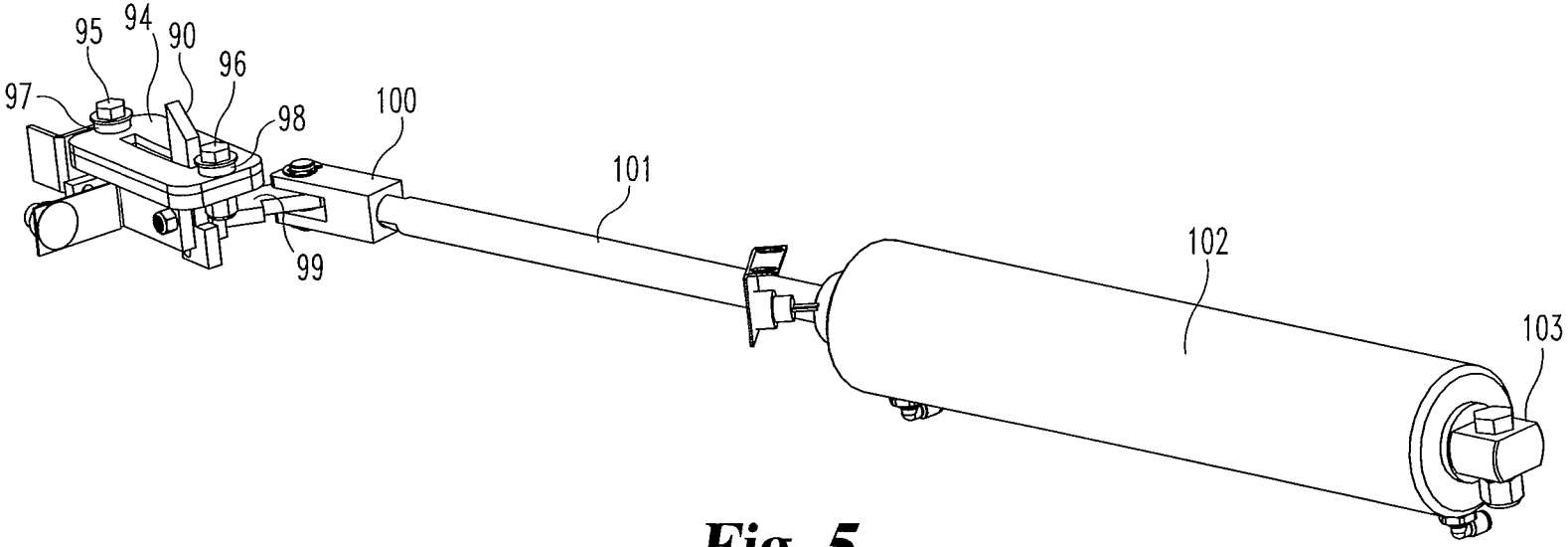
FIG. 5 is an enlarged perspective view of the driving mechanism for rotating the carousel.
Figure 6:
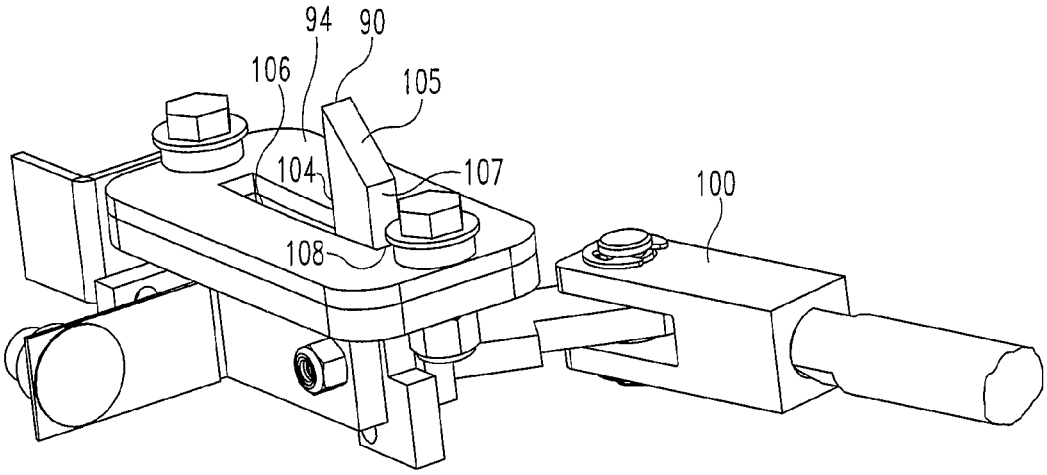
FIG. 6 is fragmentary perspective view of the distal end of the driving mechanism.

Carrier 94 (FIGS. 5 and 6) is mounted beneath bottom wall 44 and includes a pair of studs 95 and 96 extending through the bottom wall slot 91. A groove 97 and 98 formed by studs 95 and 96 provide a bearing surface as carrier 94 moves the length of the slot with the head of each stud having an enlarged portion immediately above grooves 97 and 98 to keep the carrier engaged with the bottom wall. Carrier 94 is pivotally mounted by arm 99 to the bifurcated distal end 100 of piston rod 101, in turn, moved back and forth by pneumatic or gas cylinder 102. Cylinder 102 is operable to force extension and retraction of piston rod 101 to move finger 90 back and forth in slot 91. Proximal end 103 of cylinder 102 is connected to the main frame of the dispenser.

Finger 90 releasably engages the bottom portion of the carousel. The finger is pivotally mounted to carrier 94 and has a vertical surface 104 in contact with the carousel as the piston rod extends thereby rotating the carousel ⅛ of a turn as the finger moves from slot end 93 towards slot end 92. Once the carousel has been rotated the appropriate amount, the piston rod retracts with beveled surface 105 contacting the bottom of the carousel thereby causing the finger to pivot downwardly in slot 106 of carrier 94 disengaging the carousel and allowing the finger to return to slot end 93 without corresponding movement of the carousel. Beveled surface 105 terminates at vertical finger surface 107 in contact with slot edge 108 thereby holding the finger vertically upright as the finger is then extended for an additional carousel rotation.

Extending between the bottom ends of the outward vertical members and the inwardly located vertical members forming the compartments is a contact member that extends beneath the carousel to be engaged by the spring loaded finger 90. For example, contact member 109 (FIG. 3) has its opposite ends fixedly attached to outward vertical member 70 and inwardly located vertical member 69. Contact member 109 or another member attached thereto extends beneath shelf wall 78 and is engaged by the vertically extending surface 104 (FIG. 6) of finger 90. The finger upon extension of piston rod 101 (FIG. 6) contacts member 109 as the finger moves from slot end 93 to slot end 92. Upon retraction of the piston rod, finger 90 moves in a reverse direction toward slot end 93 with beveled surface 105 contacting the contact member 110 (FIG. 3) extending between vertical members 66 and 67 with finger 90 then being forced downwardly into carrier slot 106 until the finger is on the opposite side of member 110 thereby being ready for the next carousel rotation. Instead of having finger 90 contacting members 109 and 110 any projection beneath the shelf may be utilized to cause rotation.

Finger 90 rotates the carousel in a clockwise direction as viewed in FIG. 3. Once the finger has reached the end of the slot, three tank compartments are appropriately aligned with the three doors 37-39. Once a door is opened, allowing access by the consumer, the carousel is prevented from rotating in a counterclockwise direction as viewed in FIG. 3 by a catch or lock mechanism located at the top of the carousel.

Figure 8:
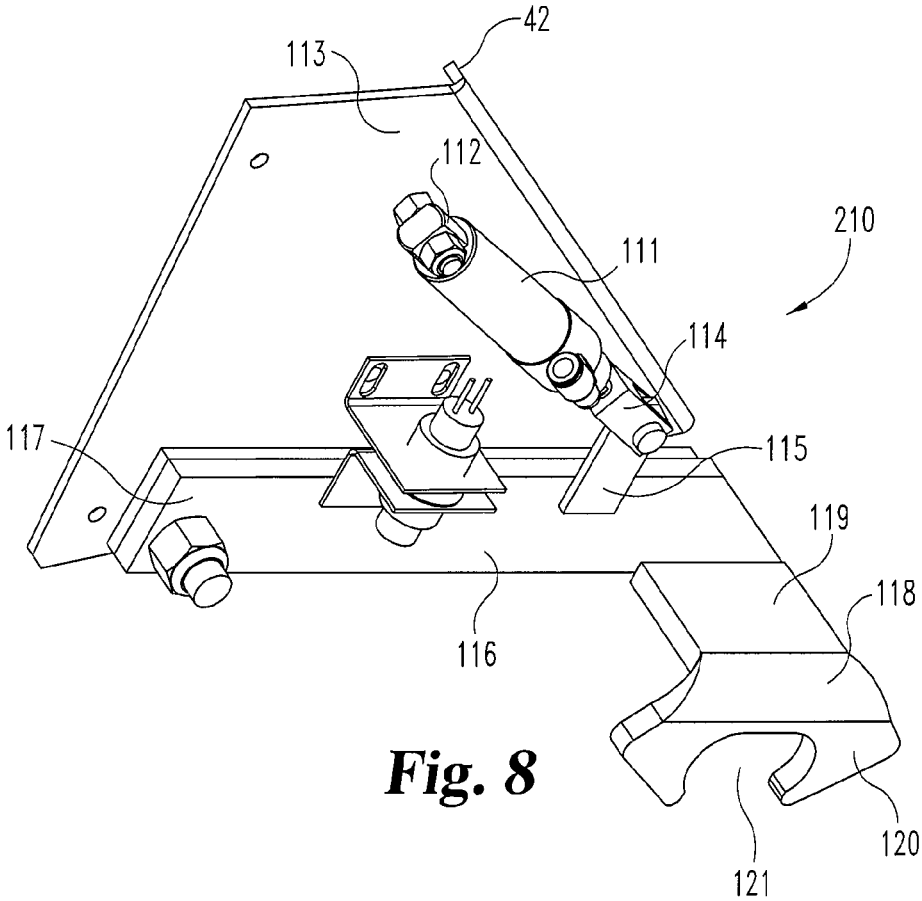
FIG. 8 is a bottom perspective view of the locking mechanism for limiting rotation of the carousel.
Figure 10:
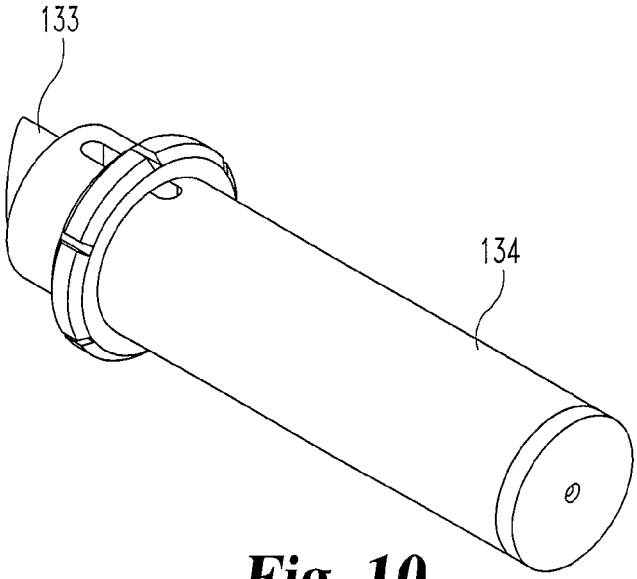
FIG. 10 is an enlarged perspective view of one of the door locks.

Catch mechanism 210 (FIG. 8) has a pneumatic or gas cylinder 111 with a proximal end 112 pivotally mounted to a horizontally extending wall 113, in turn, attached to main frame 42. The extendable piston rod has a bifurcated end 114 pivotally attached to arm 115, in turn, fixedly attached to arm 116 having a proximal end 117 pivotally mounted to wall 113. A catch arm 118 has a proximal end 119 fixedly mounted to arm 116 with the distal end 120 forming a catch recess 121 releasably and lockingly engageable with the outwardly located vertical members forming the compartments. For example, once the carousel has been rotated in a clockwise direction thereby aligning three compartments between members 123 and 67 with the three doors 37-39, cylinder 111 is activated pivoting the distal end 120 outwardly until the top end 124 of member 125 is located within recess 121. The carousel is thereby prevented from rotating in either direction. Similarly, as the carousel is rotated an additional ⅛ turn, a new set of carousel compartments are located behind the doors thereby positioning top end 122 of vertical member 123 (FIG. 3) immediately adjacent hand 120 with the cylinder 111 then being activated causing the hand to pivot outward until the top portion 122 is located within recess 121. Once the doors are closed, cylinder 111 is activated to withdraw the hand from the vertical member allowing cylinder 102 to then activate and move spring loaded finger 90 to again rotate the carousel for an additional ⅛ turn. In sequential fashion, upon receipt of a command, the carousel is caused to rotate positioning the compartments in sequential fashion behind the doors.

The compartments are designed to center the tank or container within the compartment. Typically, an LP tank has a relatively small top end which is formed by the tank valve whereas the bottom end of the tank is relatively large and round. Thus, a centering bracket 115 (FIG. 3) is fixedly mounted to one of the side walls forming each compartment so that the distance between side walls is reduced. The size of the centering bracket 115 is selected to prevent an LP tank from being inserted upside down and requiring the tank to be inserted right side up with the reduced top valve end located at the top of the compartment. Likewise, since each compartment is wedge shaped, the tanks are automatically centered as they are pushed into the compartment.

Each door opening 49-51 (FIG. 2) includes a slanted entrance bottom wall located beneath each door and leading to the carousel shelf. For example, wall 116 slants in a downward direction as the wall extends outwardly thereby providing an automatic liquid drain to prevent ice build up between the wall and the closed door. To minimize the carousel locking mechanism 210 (FIG. 8) from sticking as a result of foreign material including dirt and ice, the mechanism is located at the top of the carousel beneath members 83 and 84 and top wall 32.

An exhaust vent 130 is provided on the top wall 32 (FIG. 1) of the cabinet. An exhaust fan 171 (FIG. 7) is mounted directly beneath vent 130 to main frame 42 and has an intake tube 172 extending downwardly through the length of the cabinet. The tube may have vents formed therein to allow evacuation of gas from various levels of the cabinet out through vent 130. Appropriate gas sensors may be located at various positions within the cabinet to sense the presence of gas and to activate the fan.

Each door and compartment combination include a door sensor, a tank container sensor, a pneumatically operated door lock, and a spring for popping the door open once unlocked. The door 37 of compartment 74 (FIG. 9) will now be described it being understood that an identical description applies to the remaining two doors 38 and 39 and their associated compartments. Door 37 (FIG. 9) has a vertically extending proximal edge portion 136 hingedly mounted to the main frame of the dispenser. The vertically extending distal edge portion 131 includes an opening 132 into which the distal end 133 of the piston rod associated with a pneumatic or gas cylinder 134 projects. Cylinder 134 (FIG. 9) is mounted to the dispenser main frame and includes an extendable piston rod which projects outwardly into opening 132 locking the door in the closed condition. Once gas pressure is applied to cylinder 134, the piston rod is caused to retract moving distal end 133 apart from the door and allowing a leaf spring 136 to force the door to the open position. Spring 136 is mounted to the wall surrounding the front of compartment 74. A commercially available door sensor 137 is mounted to the same wall having spring 136 mounted thereto and is depressed with the door is in the closed position.

A vertical rack 138 is fixedly mounted to the bottom wall of the dispenser and includes a commercially available separate cylinder sensor 139 to detect when activated the presence of a cylinder or a tank within the compartment. Sensor 139 may be a proximity type of sensor or any type of sensor. A depressible spring wall 140 is mounted to the door 37 and projects inwardly when the door is closed to engage the tank or cylinder within the compartment and force the tank or cylinder rearward to activate sensor 139. When the door is opened and the tank or cylinder is removed, the sensor 139 then detects the absence of a tank or cylinder within the compartment. Likewise, separate sensors 151 and 152 are used to detect whether doors 38 and 39 are closed or opened and whether a tank or cylinder is located within the associated compartment. A separate cylinder lock 134 is provided for doors 38 and 39.

Figure 2:
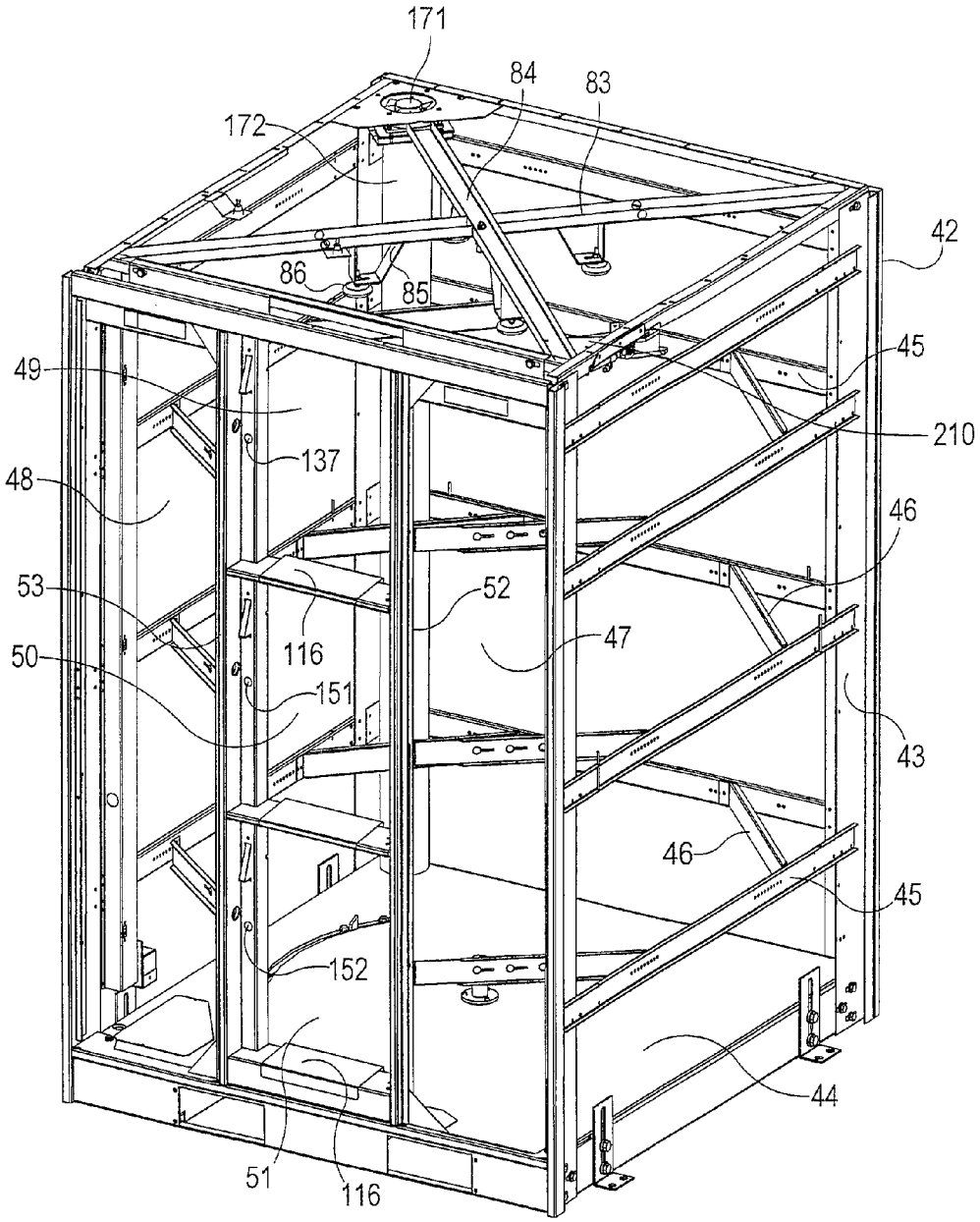
FIG. 2 is a front perspective view of the main frame of the dispenser of FIG. 1.
Figure 9:
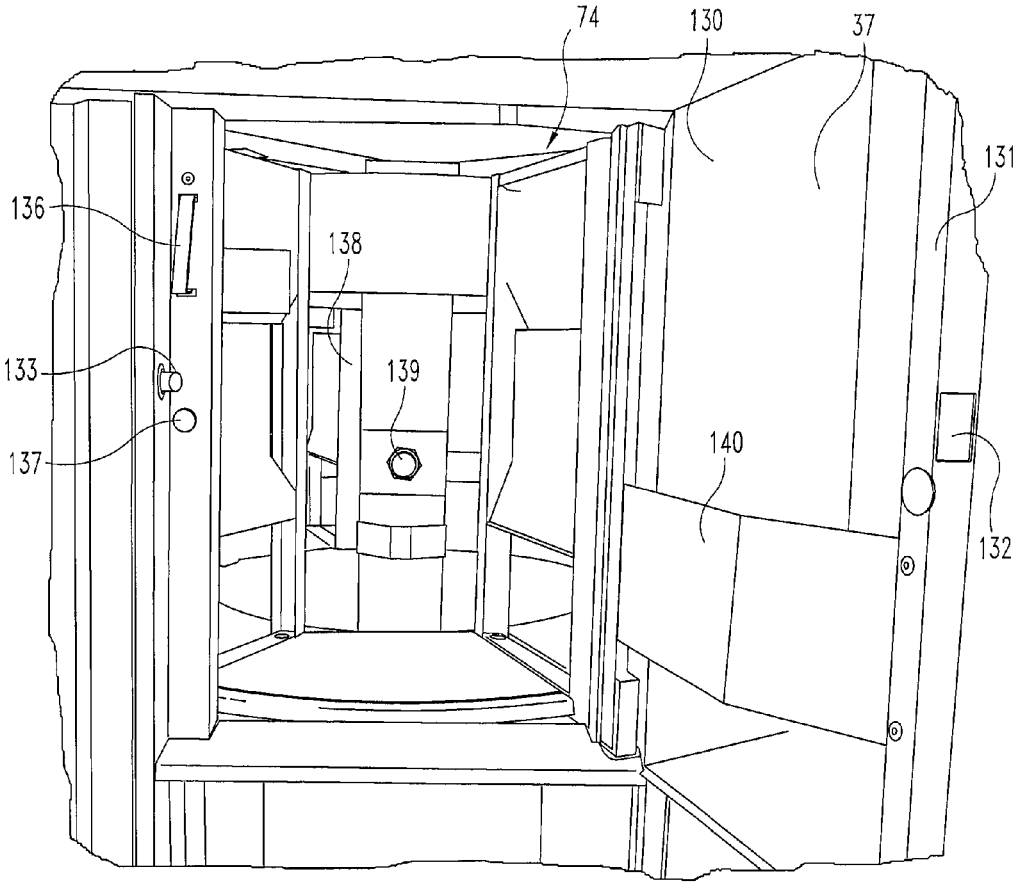
FIG. 9 is a fragmentary front view of the top door and compartment there behind.
Figure 11:
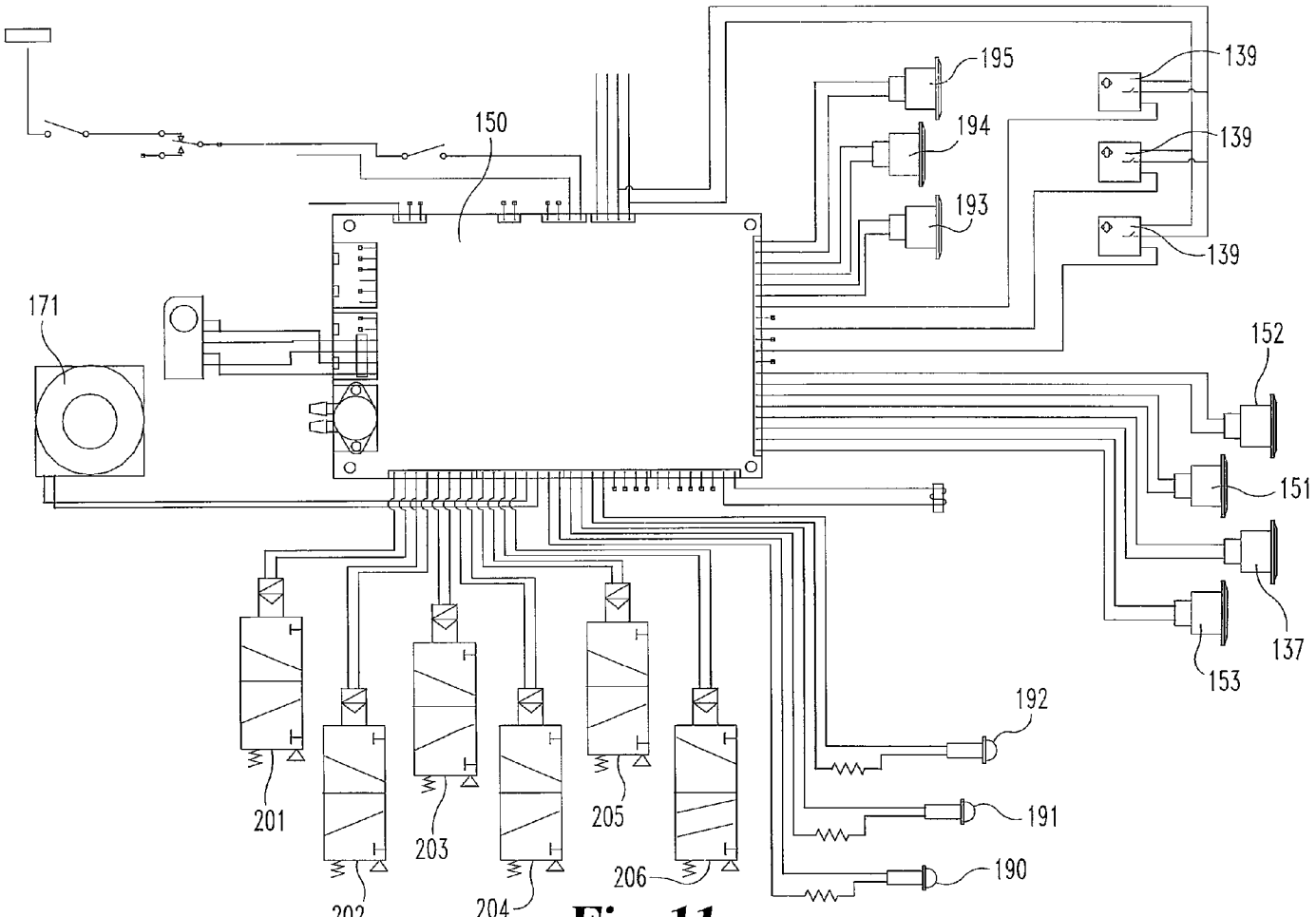
FIG. 11 is an electrical schematic of wiring connections between the pneumatic (Inputs/Outputs) board and the different sensors and solenoid valves.
Figure 12:
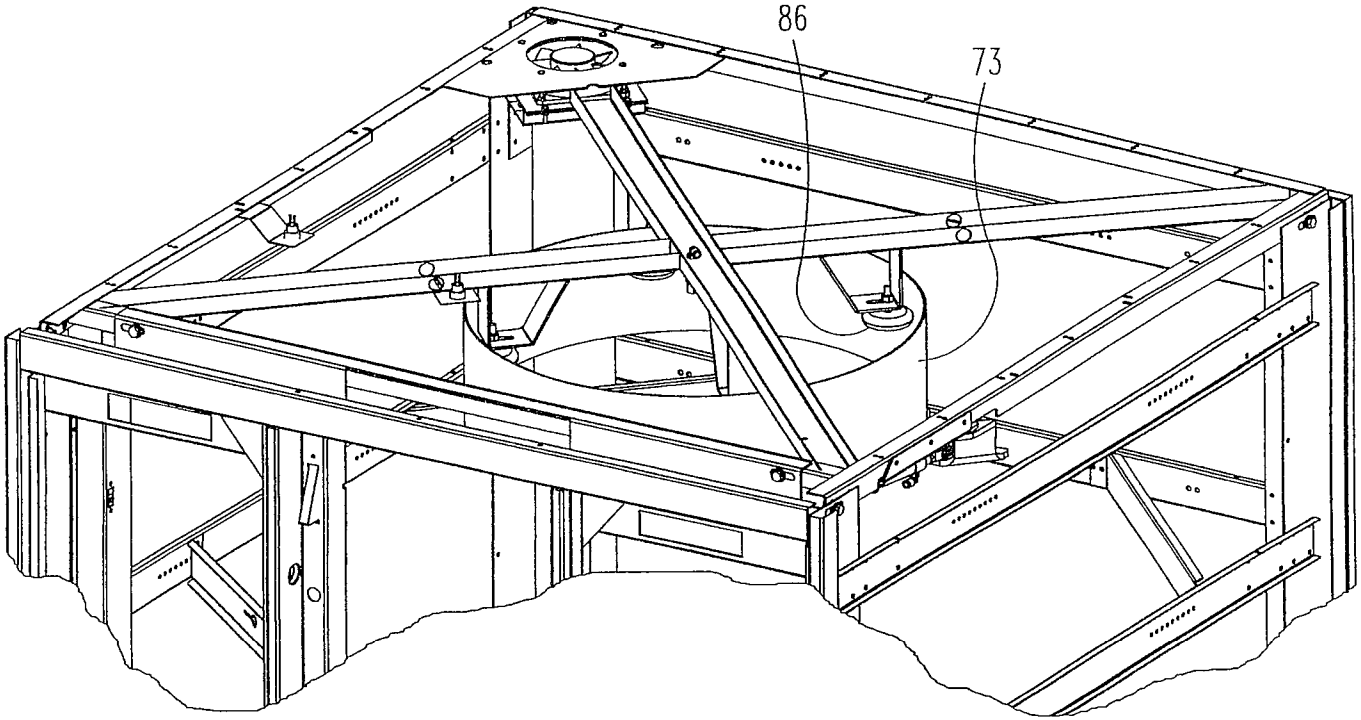
FIG. 12 is fragmentary, perspective, top view of the carousel ring wall 73 Engaged by the roller wheels 86.
Figure 13:
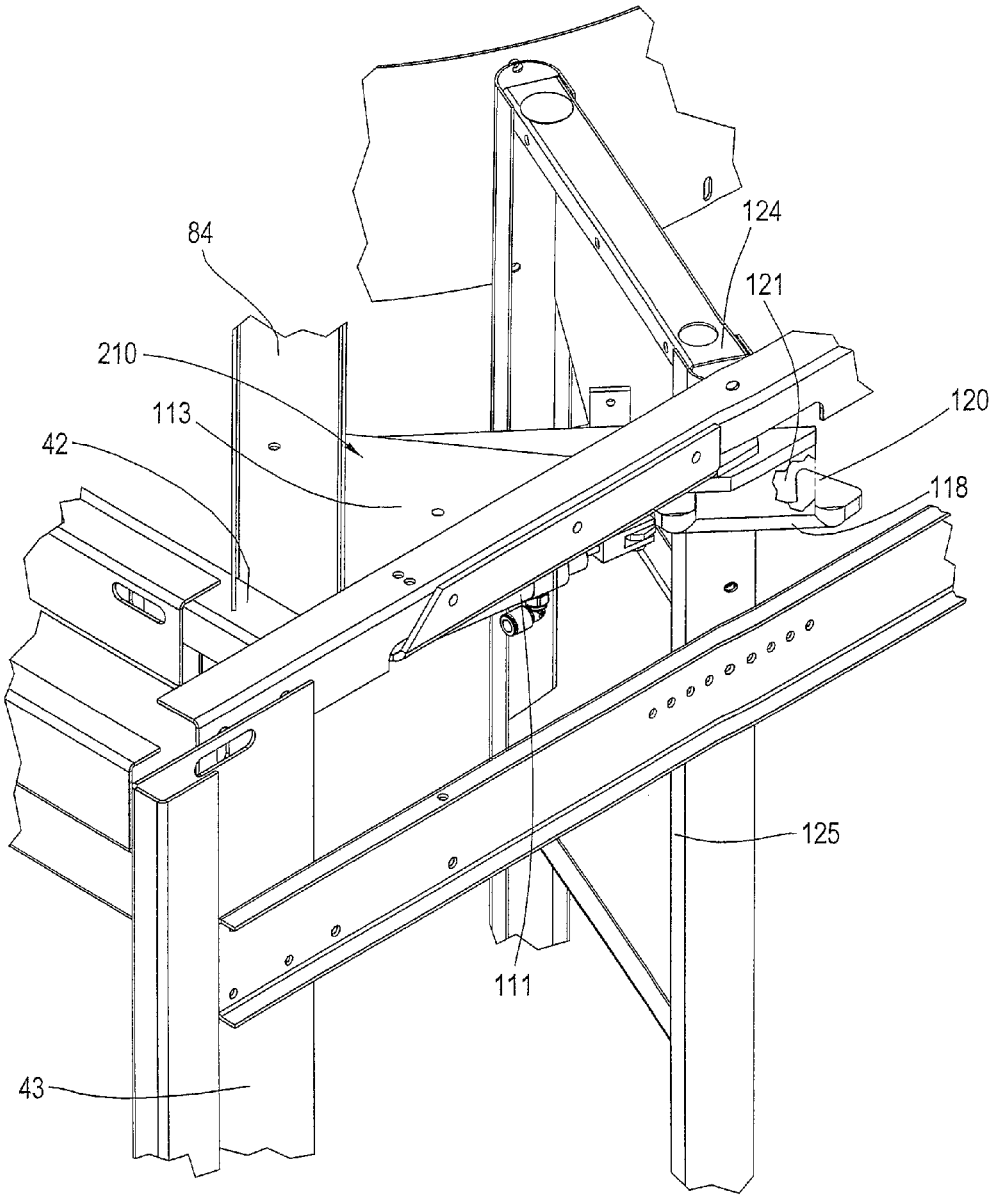
FIG. 13 is a fragmentary perspective interior view looking upward of the Locking mechanism 210.

Six solenoids 201-206 (FIG. 11) control the flow of gas which is nitrogen to the cylinders to rotate the carousel, lock carousel in place, and lock the three doors in the closed position. A pneumatic board 150 (FIG. 11) includes a microprocessor that receives the sensed data from the three door sensors 137, 151 and 152 (FIGS. 2 and 9). The sensors are connected to the micro processor included in the pneumatic board as are the solenoids 202-204 in turn connected to the door gas cylinders with one gas cylinder provided for each door. Solenoid 205 is associated with the locking cylinder 111 is connected to the microprocessor to limit rotation of the carousel. Solenoid 206 connected to the microprocessor in the pneumatic board is connected to the cylinder 102 (FIG. 5) to drivingly rotate the carousel. The remaining solenoid 201 is connected to solenoids 202-206 to control the flow of nitrogen to the remaining solenoids 202-206 which in turn are connected to the respective cylinders to lock the three doors, cause rotation of the carousel, and lock the carousel in place. Three LEDs 190-192 are associated one each with doors 37-39 and light when their respective top, middle or bottom door is open. The pneumatic board is the component that controls the mechanical operation of the kiosk. The board reads the input signals from the sensors connected to the board and sends a signal to the appropriate solenoids.

The following are magnetic sensors, normally open and close an electrical circuit once the appropriate magnet is in their immediate proximity: Home sensor 153, Top Door sensor 137, Middle Door sensor 151, Bottom Door sensor 152, Lock sensor 193, Count sensor 194, and Drive Cylinder sensor 195.

Home sensor 153 detects when the carousel has rotated and is in the "Home" position. That is, when the three initial compartments are facing the doors directly. Such provides a starting point for the dispenser.

Top Door sensor 137 detects when the "Top" door has been shut closed. This magnetic sensor is mounted on the left side of the compartment. The door has a magnet mounted on so when the door is closed, the magnetic field of the magnet closes the circuit allowing the electrical current to flow to board 150 which processes the input signal. If the current flow is interrupted, that is, when the door is open; then, the board sends and output signal (electrical current) to turn on LED Light 190 and stay on until the door is closed.

Middle Door sensor 151 has the same operation as the Top Door sensor and instead lights LED Light 191 when the middle door is open.

Bottom Door sensor 152 has the same operation as the Top Door sensor and instead lights LED Light 192 when the bottom door is open.

Lock sensor 193 determines if the locking arm is in the appropriate position locking the carousel in place so it cannot be rotated. Once the board senses a signal corresponding to when the carousel is not locked the board sends an output signal to the Solenoids 201 and 206 so the Drive Cylinder 102 can be actuated and the carousel can rotate.

Count sensor 194 senses when the carousel is advancing to its next position. A magnet located in an upright within the main frame 42 will be aligned with the count sensor 194 for a split second. When the board reads that signal, it waits for a short input coming from the lock sensor 193 and then cuts the output voltage going into the solenoid 206 so the drive cylinder 102 stops pushing and retracts to its initial position. The retraction of cylinder 102 occurs in combination of the input signal coming from the lock sensor 193 once the carousel has been locked in place.

Drive Cylinder sensor 195 senses when the drive cylinder 102 is fully retracted and sends an input signal to board 150. When the board receives this signal, it cuts the output voltage going to Solenoid 201 and checks that Solenoid 206 is not energized. Thus, drive cylinder 102 remains fully retracted and ready for the next rotation.

Solenoid 205. When the board is controlling a rotation, the board checks for the input signal from the Drive Cylinder 102 and the absence of a signal from the Lock sensor 193. When the rotation command starts, it sends an output signal to Solenoid 201 to supply nitrogen to solenoid 205 and unlock the carousel so the rotation can be started. Once the board detects the absence of the input signal from the Drive Cylinder sensor 195 and reads the input from the Count sensor 194, board 150 cuts the output current off going to solenoid 205 so the locking arm extends and can lock the carousel back into position.

Door Solenoids 202, 203 and 204 are the solenoids supplying nitrogen to the door lock associated with doors 37-39 so that the latch can retract and the doors can open when required. Solenoids 202-204 receive signals from board 150 and act in combination with the Top, Middle and Bottom Door sensors 137, 151, & 152 respectively.

Tank sensors 139 are normally open sensors which detect when a cylinder has been placed inside a compartment. Three sensors 139 are provided with a separate sensor provided for each compartment. When the cylinder is inside the compartment, it closes the electrical circuit allowing the board to see an input voltage for the top, middle and bottom compartments respectively. In the case of an exchange, the first door is going to open for the customer to insert the empty cylinder. A particular door opens when the board sends an output signal to solenoid 201 plus solenoid 202, or solenoid 203, or solenoid 204 for the top, middle or bottom doors respectively.

In the case that the top door opens, board 150 checks for an input signal from the Top sensor 139 immediately after it reads the input signal for the Top Door sensor 137 which indicates that the door is closed. If board 150 does not read the input signal from the Top sensor, it will open the Top Door two more times by energizing the outputs for solenoid 201 and solenoid 202. If the board does not see an input signal after the third attempt, it will send a command to the main board to void the transaction so the customer will not be charged.

If board 150 sees the input signal from the Middle Inductive sensor 139, it will send an output signal to solenoid 201 and solenoid 203 so the Middle Door opens and the customer takes the full cylinder out of the compartment. Once the board detects that the Middle Door has been closed by reading sensor 151, it checks for the absence of signal from the Middle Tank or Cylinder sensor 139. If the board detects an input signal, it opens the door again so the customer has another opportunity to retrieve the cylinder. The machine does this one more time if the cylinder was not taken out the second time. If this happens, the board is going to "assume" that there is a malfunction of the sensor and it will send a command to charge the customer and report an error in the database. If in fact, the board does not see a signal from the Middle sensor, it will send a command to complete the transaction charging the customer. That is to avoid losing a cylinder in the case that there was a malfunction of the tank sensor. The board will then send a command to report an error in the database so the sensor can be inspected and replaced if necessary.

During the purchase of a full cylinder, the paragraph above describes the process that occurs to dispense a cylinder. The sequence would be the same for doing an exchange or a purchase using different compartments. The only difference is that the board is going to look for input signals from other ports and also send output signals to the appropriate ports.

When a full cylinder is taken out of the Bottom Door compartment, the board will do the process for an exchange by receiving the empty cylinder into the Bottom Door compartment, and then it will do a rotation to the next set of compartments in the carousel as previously mentioned and dispense the full cylinder from the Top Door compartment.

A propane sensor is provided to generate an analog input to the board which registers the concentration of propane (hydrocarbons) in parts per million in the surrounding air. If the concentration is above the threshold value, the board sends an output signal to the Fan 171 so the gas can be exhausted outside of the kiosk. If the gas cannot be exhausted within two minutes or if there are three occurrences within 30 minutes, the pneumatic board sends a signal to the main board to report the issue to the server and database and then to the web portal and the propane supplier. If a propane alert is sent out, the kiosk shuts down and displays an 'an of service' message. This analog reading is reported to the server and database upon every check in regardless of its value.

A pressure sensor is provided to generate an analog input to the pneumatic board indicating the pressure in psi of the nitrogen in the lines used to operate the dispenser. If the pressure of nitrogen in the lines drops below a certain level, for example, 60 psi, the pneumatic board sends a signal to the main board to report the issue to the server and database and then to the web portal and the propane supplier. This analog reading is reported to the server and database upon every check in regardless of its value.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A self-serve kiosk for storing and dispensing tanks comprising a main frame with a bottom wall, top wall and side walls defining an enclosure for storage and dispensing of tanks;

a carousel rotatably mounted atop said bottom wall about a vertical axis of rotation, said carousel having a plurality of separate shelves located around said axis on a plurality of levels located along said axis for receiving a single tank on each shelf;

a plurality of doors hingedly mounted to said main frame and movable to and from open positions allowing access to said shelves and closed positions limiting access to said shelves, one of said doors is provided for each level leading to a shelf located behind each door;

a driver mounted on said main frame and engaged with said carousel for drivingly rotating said carousel about said axis in a single direction and position a shelf behind each door, said driver is a gas driver and includes a gas cylinder mounted to said main frame and having an extendable piston rod with a distal end, a spring loaded finger projecting upwardly from said bottom wall of said main frame and engageable with said carousel to rotate said carousel about said axis of rotation locating a separate shelf behind each door, and, a linkage connecting said distal end of said piston rod with said finger; and, a lock mounted on said main frame and releasably engageable with said carousel limiting movement of said carousel;

and wherein, said bottom wall has a curved slot through which said spring loaded finger projects, said cylinder moves said rod in a first direction with said finger moving a distance along said slot while engaged with said carousel to locate said shelves behind said doors in sequential fashion, said finger disengages said carousel when said rod moves in a direction opposite to said first direction to reposition said finger to engage said carousel for the next movement of said carousel.

2. The kiosk of claim 1 and further comprising:

a plurality of springs mounted to said main frame with a separate spring provided for each door, said springs being positioned against said doors to pop said doors to an open position when unlocked;

members mounted to said doors that are operable to engage containers inserted in said compartments and force said containers further into said compartments as said doors close;

a plurality of door locks mounted on said main frame with a separate door lock provided for each compartment and releasably lockable with said doors;

a plurality of door gas cylinders connected to said door locks;

door sensors mounted to said main frame sensing whether the doors are closed; and, tank sensors mounted on said carousel with a separate tank sensor provided for each compartment to sense whether a tank is located in said compartments.

3. A self-serve kiosk for storing and dispensing tanks comprising a main frame with a bottom wall, top wall and side walls defining an enclosure for storage and dispensing of tanks;

a carousel rotatably mounted atop said bottom wall about a vertical axis of rotation, said carousel having a plurality of separate shelves located around said axis on a plurality of levels located along said axis for receiving a single tank on each shelf;

a plurality of doors hingedly mounted to said main frame and movable to and from open positions allowing access to said shelves and closed positions limiting access to said shelves, one of said doors is provided for each level leading to a shelf located behind each door;

a driver mounted on said main frame and engaged with said carousel for drivingly rotating said carousel about said axis in a single direction and position a shelf behind each door, said driver includes a cylinder mounted to said main frame and having an extendable piston rod with a distal end and further includes a spring loaded finger projecting upwardly from said bottom wall of said main frame and engageable with said carousel to rotate said carousel about said axis of rotation locating a separate shelf behind each door; and, further including a linkage connecting said distal end of said piston rod with said finger, said bottom wall has a curved slot through which said spring loaded finger projects, said cylinder moves said rod in a first direction with said finger moving a distance along said slot while engaged with said carousel to locate said shelves behind said doors in sequential fashion, said finger disengages said carousel when said rod moves in a direction opposite to said first direction to reposition said finger to engage said carousel for the next movement of said carousel; and, a lock mounted on said main frame and releasably engageable with said carousel limiting movement of said carousel.

4. The self-serve kiosk of claim 3 wherein:

said driver includes a carrier upon which said finger is mounted, said carrier includes a pair of spaced apart studs projecting upward through said slot keeping said carrier engaged vertically and horizontally with said bottom wall of said main frame guiding said finger along said slot.

5. A self-serve kiosk for storing and dispensing tanks comprising a main frame with a bottom wall, top wall and side walls defining an enclosure for storage and dispensing of tanks;

a carousel rotatably mounted atop said bottom wall about a vertical axis of rotation, said carousel having a plurality of separate shelves located around said axis on a plurality of levels located along said axis for receiving a single tank on each shelf;

a plurality of doors hingedly mounted to said main frame and movable to and from open positions allowing access to said shelves and closed positions limiting access to said shelves, one of said doors is provided for each level leading to a shelf located behind each door;

a driver mounted on said main frame and engaged with said carousel for drivingly rotating said carousel about said axis in a single direction and position a shelf behind each door; and, a lock mounted on said main frame and releasably engageable with said carousel limiting movement of said carousel;

said lock is a gas lock and includes:

a gas cylinder mounted to said main frame and having an extendable piston rod; and, an extendable arm connected to said piston rod and movable to said carousel to releasably lock said carousel in position when one of said doors is open limiting movement of said carousel as a tank is removed or inserted onto a shelf;

said carousel has a plurality of intermediate walls extending radially outward from said axis separating said shelves apart; and, said gas lock includes a member movably mounted to said main frame and connected to said piston rod, said member has a hand thereon forming a recess to lockingly receive one of said intermediate walls to hold said carousel stationary, said carousel has a top portion adjacent which said hand is located to limit contact by said hand with any foreign material located at the bottom of said carousel.

6. The kiosk of claim 5 wherein:

said carousel includes a carousel frame rotatably mounted to said bottom wall about a vertical axis of rotation and extending from said bottom wall toward said top wall, said shelves are fixed together and extend around said axis being arranged in at least three levels spaced vertically apart with said levels aligned with said doors, said main frame has downwardly slanted entrance bottom walls located beneath each of said doors providing a liquid drain.

7. The kiosk of claim 6 wherein:

said carousel frame includes a plurality of intermediate walls forming compartments and separating said shelves apart, said intermediate walls in each compartment diverge as they extend radially outward from said axis and cooperatively center an item inserted in the compartment when the door aligned with the compartment closes and contacts the inserted item, said carousel frame includes a projection located in each compartment limiting insertion of said item in a compartment to an upright position.

8. The kiosk of claim 7 wherein:

said carousel frame includes a plurality of wheels rotatably mounted thereto in rolling contact with said bottom wall and supporting said carousel frame thereon, said main frame includes a plurality of center ring wheels rotatably mounted to said top wall and extending into said carousel frame limiting sideways movement of said carousel frame about said axis as said carousel frame rotates.

9. An LP gas tank dispenser comprising:

a cabinet including a cabinet frame with a top portion and a bottom portion, said bottom portion has a wall with a curved slot extending therethrough;

a carousel having compartments and rotatably mounted atop said wall of said cabinet frame about a vertical axis of rotation, said curved slot having a length to correspond to rotation of the carousel about the vertical axis of rotation through an angle equal to 360 degrees divided by the number of compartments on a level;

a ring shaped wall mounted to said carousel and located at said top portion of said cabinet surrounding said vertical axis;

a plurality of wheels mounted to said cabinet frame at said top portion rotatably extending against said ring shaped wall to center said carousel on said vertical axis as the carousel rotates;

a mechanism for rotating said carousel on said cabinet frame, said mechanism includes a first cylinder with a piston rod having a spring biased finger extending upwardly from said bottom portion of said cabinet frame through said curved slot against said carousel frame and, an extendable rod connected to said spring loaded finger to move said finger rotating the carousel frame.

10. The LP gas dispenser of claim 9 wherein:

said carousel has a carousel frame with a plurality of compartments located along the length of said axis being arranged in at least two levels with said compartments extending around said axis in each level in an equal number, said compartments increase in width as they extend outwardly from said axis of rotation.

11. The LP gas dispenser of claim 10 and further comprising:

a top door and a bottom door movably mounted to said cabinet with said compartments alignable therewith;

springs positionable between said cabinet frame and said top door and said bottom door operable to force said top door and said bottom door to open;

walls located beneath said top door and said bottom door that slant downward in a direction from interiorly within said compartments to exterior of said compartments to provide a liquid drain for said compartments; and second cylinders with extendable piston rods mounted to said cabinet with the rods having distal ends extendable into said doors to lock same in a closed position.

12. The LP gas dispenser of claim 11 and further comprising:

a third cylinder with a hand mounted thereto movable against said carousel to limit rotation thereof, said hand being located by said top portion of said cabinet frame.

* * * * *